US007228907B2

(12) United States Patent
Schmidt et al.

(10) Patent No.: US 7,228,907 B2
(45) Date of Patent: Jun. 12, 2007

(54) HIGH ENERGY GAS FRACTURING CHARGE DEVICE AND METHOD OF USE

(75) Inventors: Adam C. Schmidt, Tualatin, OR (US); Richard A. Schmidt, West Linn, OR (US)

(73) Assignee: The Gas Gun, LLC, The Woodlands, TX (US)

( * ) Notice: Subject to any disclaimer, the term of this patent is extended or adjusted under 35 U.S.C. 154(b) by 0 days.

(21) Appl. No.: 11/161,113

(22) Filed: Jul. 22, 2005

(65) Prior Publication Data

US 2007/0017678 A1 Jan. 25, 2007

(51) Int. Cl.
*E21B 43/263* (2006.01)
*F42B 1/02* (2006.01)

(52) U.S. Cl. ..... 166/308.1; 166/55.1; 166/177.5; 166/297; 69/1.151; 102/309; 102/310; 102/320

(58) Field of Classification Search ..... 166/297, 166/55, 308.1, 55.1, 177.5, 299; 175/2, 67, 175/71; 89/1.15, 1.151; 102/306–310, 320
See application file for complete search history.

(56) References Cited

U.S. PATENT DOCUMENTS

| | | | | | |
|---|---|---|---|---|---|
| 1,758,358 | A * | 5/1930 | Ennis | 102/317 |
| 2,779,278 | A * | 1/1957 | Klotz, Jr. | 102/310 |
| 2,921,519 | A * | 1/1960 | Martin | 102/317 |
| 3,174,545 | A * | 3/1965 | Mohaupt | 166/299 |
| 3,270,668 | A * | 9/1966 | Silver | 102/313 |
| 4,160,412 | A * | 7/1979 | Snyer et al. | 102/307 |
| 4,184,430 | A * | 1/1980 | Mock | 102/307 |
| 4,290,486 | A * | 9/1981 | Regalbuto | 166/297 |
| 4,329,925 | A * | 5/1982 | Hane et al. | 102/310 |
| 4,798,244 | A * | 1/1989 | Trost | 166/250.01 |
| 5,005,641 | A * | 4/1991 | Mohaupt | 166/63 |
| 5,005,649 | A * | 4/1991 | Smith et al. | 166/308.1 |
| 5,690,171 | A * | 11/1997 | Winch et al. | 166/63 |
| 6,082,450 | A * | 7/2000 | Snider et al. | 166/55.2 |
| 6,494,261 | B1 * | 12/2002 | Pahmiyer | 166/281 |
| 6,732,799 | B2 | 5/2004 | Challacombe | 166/299 |
| 6,817,298 | B1 * | 11/2004 | Zharkov et al. | 102/312 |
| 6,991,044 | B2 * | 1/2006 | Zhang et al. | 175/4.6 |
| 2003/0155112 | A1 * | 8/2003 | Tiernan et al. | 166/63 |
| 2003/0155125 | A1 * | 8/2003 | Tiernan et al. | 166/299 |
| 2005/0066836 | A1 * | 3/2005 | Levi | 102/313 |

FOREIGN PATENT DOCUMENTS

WO WO 02/063133 * 8/2002

* cited by examiner

*Primary Examiner*—Jennifer H Gay
(74) *Attorney, Agent, or Firm*—Law Office of Timothy E. Siegel; Timothy E. Siegel

(57) ABSTRACT

A high energy gas fracturing device, adapted to be lowered into a well. The device comprises a closed tube made of strong material, sized to fit into the well and having at least one sidewall, which defines a set of openings. A set of closure elements seal the openings in a water-tight manner. Also, a charge of propellant is located in the closed tube, the charge achieving best performance if kept dry. Finally, an ignition element contacts the charge.

11 Claims, 3 Drawing Sheets

HIGH ENERGY GAS FRACTURING CHARGE DEVICE AND METHOD OF USE

BACKGROUND OF THE INVENTION

Deposits of valuable fluids, such as crude oil, natural gas and even water, frequently occur in geologic formations having limited permeability. Although the initial perforating of the sides of an oil well typically opens up this type of deposit for initial exploitation, the well may soon experience a drop in production and require further treatment. To address this situation, a number of different fracturing techniques have been developed including explosive fracturing, hydraulic fracturing and high energy gas fracturing (HEGF). Each of these techniques is designed to fracture the underground geologic formation, thereby increasing permeability.

HEGF appears to have an advantage over the other fracturing techniques when certain conditions exist in a well. Test observations have shown that HEGF can create several radially extending fractures, thereby increasing the chance of significantly increasing permeability of nearby rock.

One type of HEGF uses a propellant that must be kept dry and contained during combustion. In this version, a strong container bearing a charge of propellant (i.e. a low explosive) is lowered into a partially liquid filled well and the propellant is ignited. The container keeps the charge dry and constrains it to obtain the full explosive force.

Until recently, the container for the propellant charge has been torn apart in the blast. Unfortunately, this has resulted in debris being left in the well, sometimes in the form of pieces that were large enough to create problems in the further exploitation of the well.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In a first separate aspect, the present invention is a high energy gas fracturing device, adapted to be lowered into a well. The device comprises a closed tube made of strong material, sized to fit into the well and having at least one sidewall, which defines a set of openings. A set of closure elements seal the openings in a water-tight manner. Also, a charge of propellant is located in the closed tube, the charge achieving best performance if kept dry. Finally, an ignition element contacts the charge.

In a second separate aspect, the present invention is a method of performing a high energy gas fracturing of a well. The method uses an enclosed charge device that includes a closed tube made of strong material, sized to fit into the well and having at least one sidewall, which defines a set of openings. A set of closure elements seal the openings in a water-tight manner. Also, a charge of propellant is located in the closed tube, the charge achieving best performance if kept dry. In addition, an ignition element contacts the charge. To perform the method, the enclosed charge device is lowered into the well and the charge is ignited. Finally, the closed tube is lifted from the well.

In a third separate aspect, the present invention is a method of obtaining substantially uniform combustion of a charge of propellant, comprising dividing the charge into a set of sub-charges and placing the sub-charges of propellant in close proximity, but separating each sub-charge from any neighboring sub-charge by an isolating baffle. The set of sub-charges are then contemporaneously ignited.

In addition to the exemplary aspects and embodiments described above, further aspects and embodiments will become apparent by reference to the drawings and by study of the following detailed descriptions.

BRIEF DESCRIPTION OF THE DRAWINGS

FIG. 2 is a cut-away perspective view of a buffered explosive packet, a part of the device of FIG. 1.

DETAILED DESCRIPTION OF THE PREFERRED EMBODIMENT(S)

Exemplary embodiments are illustrated in referenced figures of the drawings. It is intended that the embodiments and figures disclosed herein are to be considered illustrative rather than restrictive.

Figure 1:
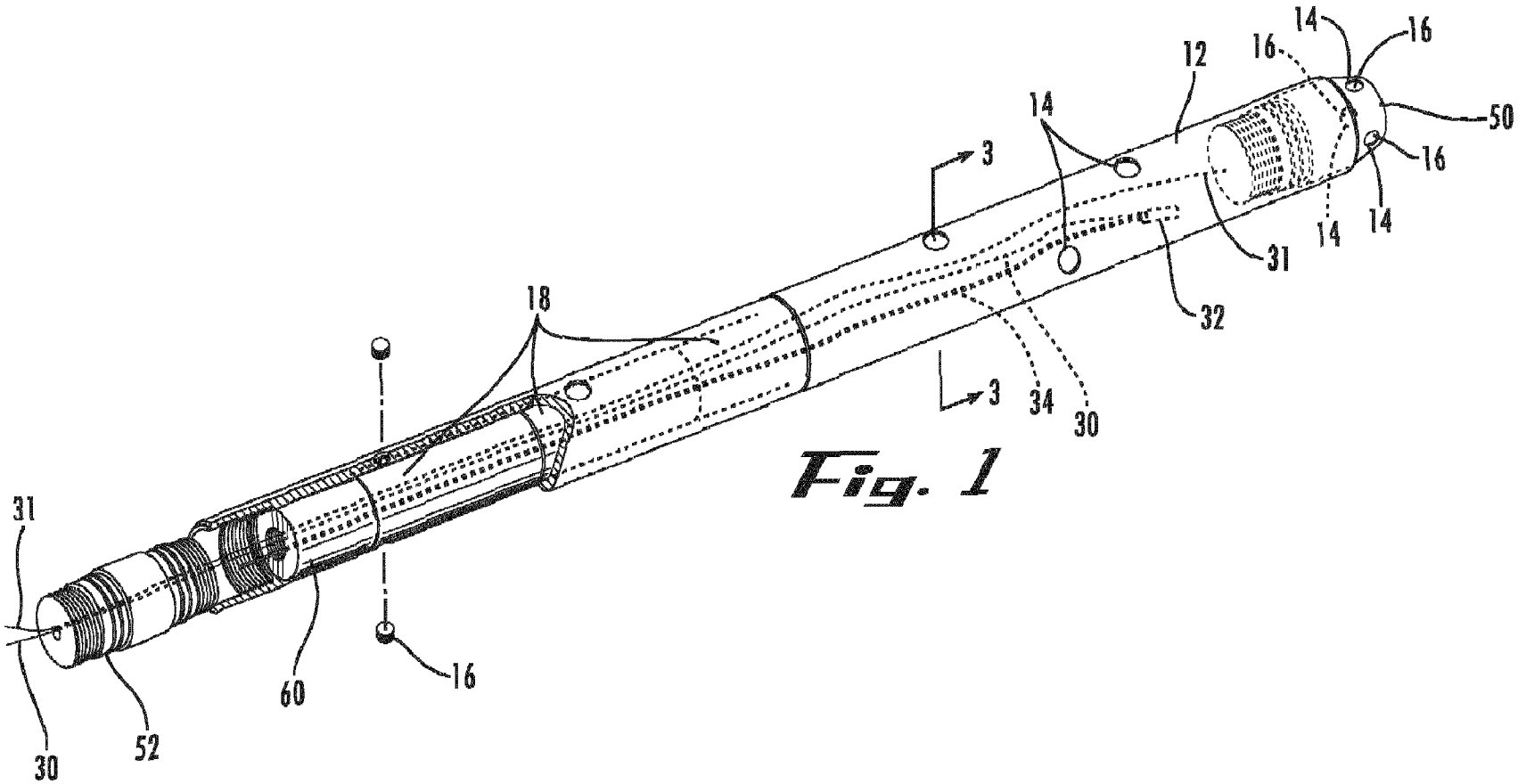
FIG. 1 is a cut-away perspective view of a high energy gas fracturing device, according to a preferred embodiment of the present invention.
Figure 7:
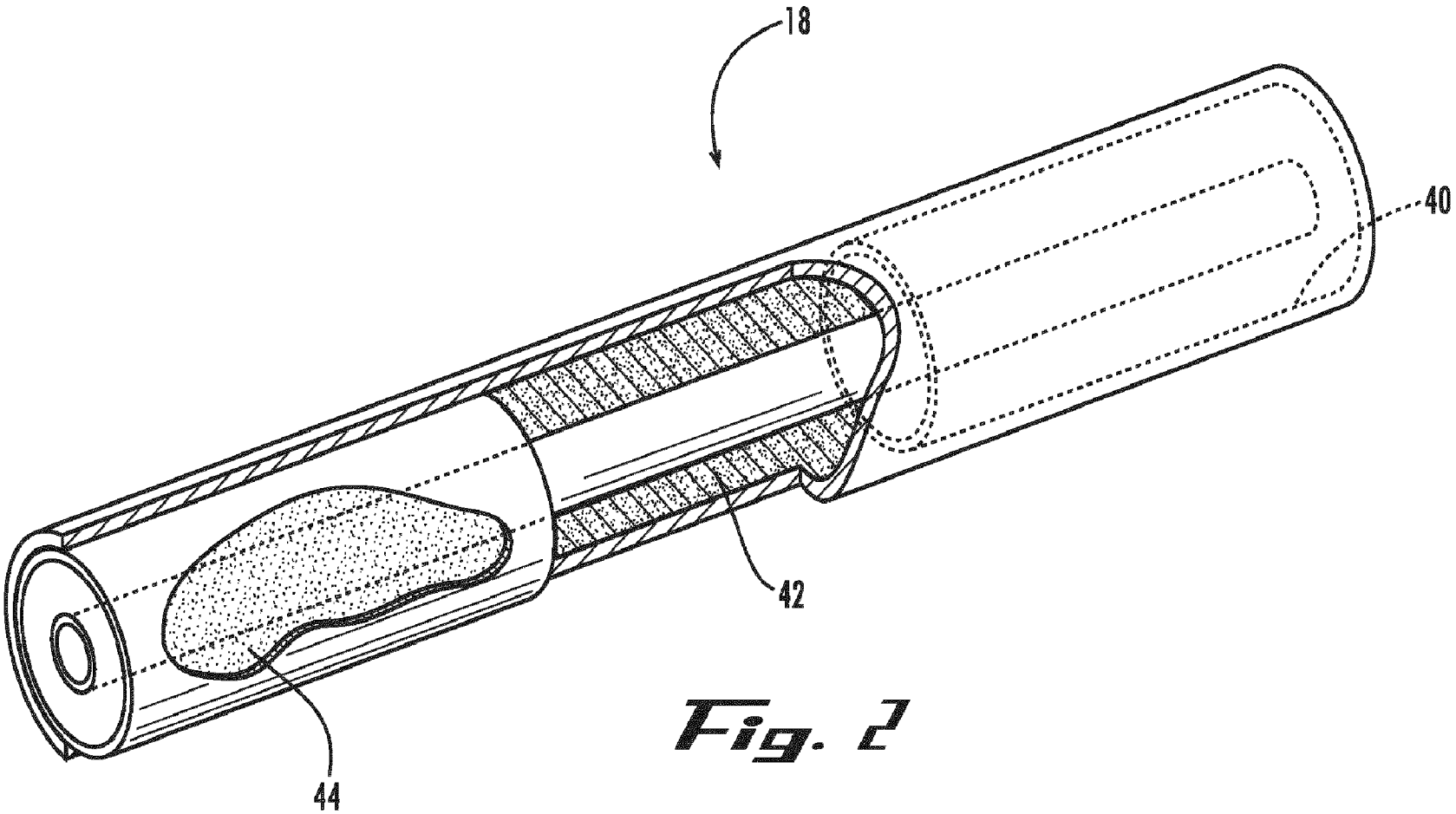

In broad overview, referring to FIG. 1, a first embodiment of the present invention is a high energy gas fracturing device 10 that includes a closed steel pipe 12 sized to fit down a well. Pipe 12 defines a set of apertures 14, shut with closure disks 16, which prevent the entry of liquid into pipe 12. Although only some apertures 14 are shown as being shut with closure disks 16, for ease of presentation, in practice all apertures 14 are shut with closure disks when device 10 is prepared for use.

The pipe 12 encloses a set of baffled charge packets 18, each containing propellant. (A "propellant" deflagrates or burns very rapidly, rather than detonates virtually instantaneously like a high explosive) A conductor wire 30 and ground wire 31 are threaded through the annular packets 18, with wire 30 terminating to a blasting cap 32, which in turn is connected with a detonating cord 34, set to detonate packets 18. Wire 30 terminates to bottom plug 50, which is discussed further below.

Device 10 can be used in oil, gas or water wells and in production, injection or disposal wells. The process begins by lowering device 10 into a well. The blasting cap 32 is detonated by the conductor wireline 30, causing detonating cord 34 to ignite the packets 18. The resulting blast forcibly ejects closure disks 16 and causes a rapid gas discharge that creates and/or widens cracks in the local geologic formation. These cracks may permit an increased flow of fluids into or out of the well. Both the device 10 and its method of use are described in greater detail below.

Referring to FIG. 2, baffled charge packets 18 include a shell 40, which may be made of cardboard, and which encompasses a charge pack 42, interposed between a pair of sand packs 44. Sand packs 44 serve the purpose of partially isolating the charge in one charge pack 42 from any adjacent charge packs 42. It has been found that in the absence of baffles, such as sand packs 44, the combustion of the propellant can progress in an unpredictable manner, causing regions of very fast combustion (hot spots) that can result in damage to pipe 12. Sand packs 44, by partially isolating one charge bearing enclosure 42 from its neighbors, prevent this from happening. Packets 18 also serve the purpose of facilitating assembly of a device 10, by reducing the need for handling of uncontained explosives.

A bottom plug 50 is a standard bottom plug from a perforating gun, except that it includes 3 apertures 14, each bearing a closure disk 16. A top sub 52 is threaded into the top of pipe 12. In general a top sub, such as top sub 52, is a standard item of down hole wireline gear, easily connectable with other wireline equipment and familiar to logging crews and other oil well hands. In an alternative preferred embodiment top sub 52 defines 3 apertures 14, each bearing a closure disk 16, and is threaded into the top threads of pipe 12. Top sub 52 can easily be sealed against down hole liquids, while still permitting the conductor wire 30 and ground wire 31 to pass through.

A steel spacer/buffer 60 is placed at either end of the interior of pipe 12. Spacer/buffers protect bottom plug 50 and top sub 52 by absorbing some of the explosive force from the propellant. Spacer/buffers 60 are less expensive than bottom plugs 50 or top subs 52 and if damaged may be discarded. Also, spacer/buffers act to keep packets 18 in position in the longitudinal center of pipe 12, where they are closer to apertures 14.

Pipe 12 has an outer diameter of 8.6 cm (3.38 in), permitting it to be lowered into a typical well, as noted. The inner diameter of pipe 12 is 5.4 cm (2.13 in). Accordingly the thickness of the circular sidewall of pipe 12 is 1.6 cm (0.63 in). A thickness of this magnitude is necessary to permit pipe 12, which is made of high strength steel, to withstand the explosive force of charges 18.

Figure 3:
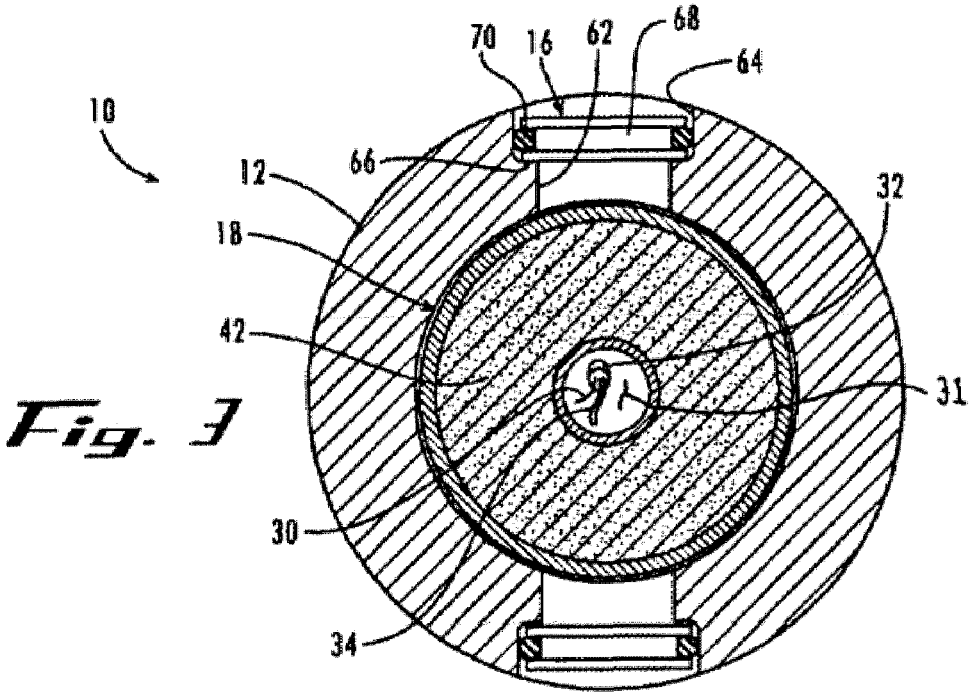
FIG. 3 is a perspective view of a blast aperture and a closure disk, which form part of the device of FIG. 1.

Referring to FIG. 3, each aperture 14 has a neck 62 that has a 1.9 cm (0.75 in) diameter. This expands out to an outwardly tapering head portion 64, that is about 2.53 cm (0.997 in) closest to neck 62 and about 2.61 cm (1.027 in) at its outermost extent. An annular seat 66 is formed where neck 62 widens out to head portion 64.

A closure disk 16 is set into head portion 64 and defines a circumferential slot 68 for accommodating an O-ring 70, which facilitates the seal created between closure disk 16 and aperture 14. As noted each disk 16 prevents liquid from entering device 10 until the ignition of charges 18.

Disks 16 are made of a polymer designed to withstand moderate temperatures and pressures, such as white acetal. For jobs in which high temperatures are to be encountered, disks 16 are made of a polymer, such as polyethermide. For jobs in which high pressures are to be encountered, disks 16 are made of a metal, such as aluminum. O-rings 70 are made of high temperature polymer, such as nitrile.

Figure 4:
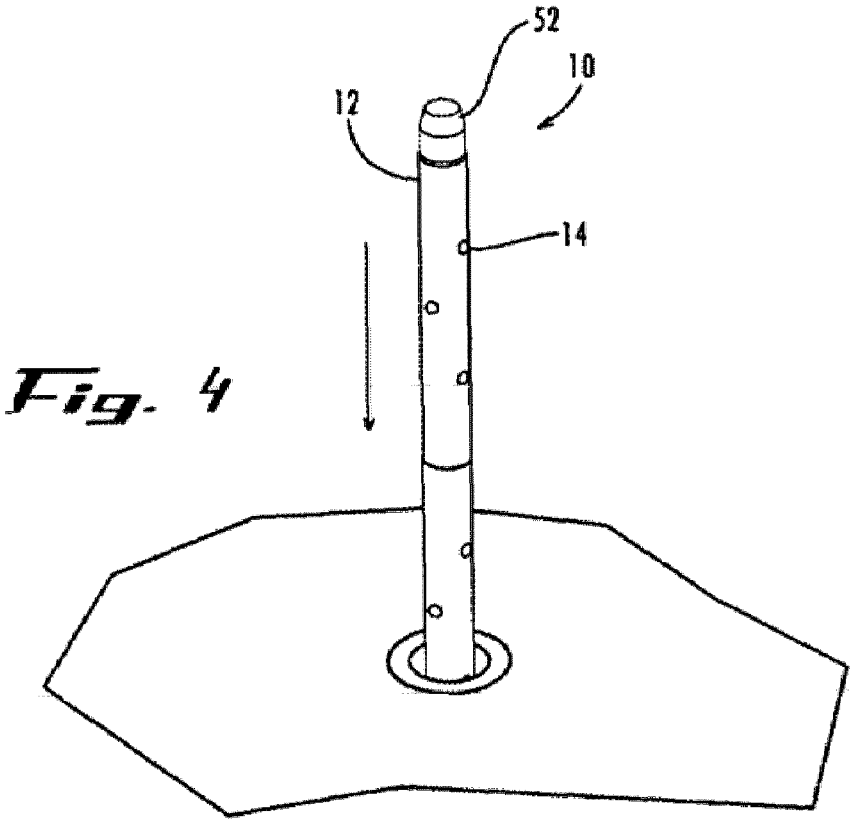
FIG. 4 is a perspective view of the device of FIG. 1, being lowered into a well.

Referring to FIG. 4, device 10 is lowered into a well that is at least partially filled with liquid. As the device 10 is lowered into the liquid, to a depth of at least 91 meters (300 ft), pressure increases against disks 16, thereby pressing each disk 16 more firmly against the corresponding annular seat 66 and enhancing the seal provided by disk 16. It should be noted although 91 meters (300 ft) generally serves as the minimum depth to which device 10 must be submerged in order to work effectively, it can be made to work even in a dry well, if steps are taken to block the gas produced from the propellant combustion from leaking upwardly or downwardly, away from device 10, once emitted. Moreover, device 10 may be very deeply submerged, to a depth at least on the order of 3,000 meters.

Next, the blasting cap 32 is detonated by the conductor wire 30, which ignites the detonating cord 34. This detonating cord ignites all of the charge packs within approximately 1 millisecond. Each charge pack preferably bears multi-perforated propellant. The multiple perforations, which expand as the combustion continues, creating more surface area, cause the charge to combust at an increasing rate.

The gasses produced are contained by the column of liquid in the well and burst out rapidly toward the sides of the well, where perforations in the well casing are found and transited. The first gas to emerge through the perforations tends to blast debris out of the perforations, while immediately subsequent gas, at an even higher pressure and velocity due to the progressive combustion, opens up new cracks in the geologic formation. The combustion is completed in about 20 milliseconds.

Propellant 42 may be either single-based (nitrocellulose), double-based (nitrocellulose and nitroglycerin), or triple-based (nitrocellulose, nitroglycerin, and nitroguanadine). These propellants may be available from Alliant Techsystems, Inc., in Radford, Va.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

The claimed invention is:

1. A high energy gas fracturing device, adapted to be lowered into a well and comprising:

(a) a tube that is closed at either end and is made of steel, sized to be lowered into and subsequently removed from said well and having a circular side wall, which defines a set of openings;

(b) a set of closure elements, sealing said openings in a watertight manner;

(c) a charge of propellant located in said closed tube; and (d) an ignition element contacting said charge;

wherein said charge of propellant is divided into sections, which are at least partially explosively isolated from one another.

2. The device of claim 1, wherein said closure elements are set into said openings so as to maintain said watertight seal when said device is lowered into liquid to a depth of 91 meters (300 feet).

3. The device of claim 1, wherein said closure elements are set into said openings so as to maintain said watertight seal when said device is lowered into liquid to a depth of 1,500 meters (4,921 feet).

4. The device of claim 1, wherein said closure elements are set into said openings so as to maintain said watertight seal when said device is lowered into liquid to a depth of 3,000 meters (9,843 feet).

5. The device of claim 1, wherein each said section is at least partially isolated from any adjacent section by isolating baffles.

6. The device of claim 5, wherein each said isolating baffle is a container filled with sand.

7. The device of claim 5, wherein each said section comprises a packing tube enclosing propellant.

8. The device of claim 7 wherein said packing tube is made of cardboard.

9. A method of obtaining substantially uniform combustion of a charge of propellant, comprising:

(a) dividing said charge into a set of subcharges, each having a prospective isotropic combustive effect, and placing said sub-charges of propellant in close proximity, but separating each subcharge from said prospective effect of any neighboring sub-charge by an isolating baffle in the form of a container filled with sand; and (b) contemporaneously detonating said set of sub-charges.

10. The method of claim 9 wherein each said subcharge has a sub-charge length and is separated from another subcharge by a distance of less than 2.5 times the sub-charge length.

11. A baffled charge packet adapted for use in assembling a charge device and comprising:

(a) a shell;

(b) a single pair of baffles in the form of containers filled with sand, enclosed in said shell; and (c) a charge pack, enclosed in said shell and interposed between said pair of baffles;

wherein said shell is made of cardboard.

* * * * *